US006298679B1

(12) United States Patent
Cheng et al.

(10) Patent No.: US 6,298,679 B1
(45) Date of Patent: Oct. 9, 2001

(54) WATER REMOVING MECHANISM FOR EVAPORATOR IN A REFRIGERATION SYSTEM

(75) Inventors: Wei-Yueh Cheng; Shih-Pei Lin, both of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/444,999

(22) Filed: Nov. 23, 1999

(30) Foreign Application Priority Data

Jun. 28, 1999 (TW) ..... 88210629

(51) Int. Cl.[7] ..... F25D 21/06

(52) U.S. Cl. ..... 62/275; 62/80; 62/272; 62/283

(58) Field of Search ..... 62/272, 283, 80, 62/275

(56) References Cited

U.S. PATENT DOCUMENTS 4,615,176 * 10/1986 Tippmann ..... 62/62
4,742,691 * 5/1988 Kennedy ..... 62/272
4,759,195 * 7/1988 Biancardi ..... 62/283
4,829,778 * 5/1989 Schlensker ..... 62/272
5,327,740 * 7/1994 Ogasawara et al. ..... 62/93
5,794,453 * 8/1998 Barnwell ..... 62/79

* cited by examiner

*Primary Examiner*—William Doerrler
*Assistant Examiner*—Mark Shulman
(74) *Attorney, Agent, or Firm*—Bacon & Thomas; Richard E. Fichter

(57) ABSTRACT

A water removing mechanism for the evaporator in a refrigeration system in which an electrode element is disposed beneath the evaporator and a pulse voltage source is provided to connect the evaporator and the electrode element to generate an electric field with high voltage and low current between the evaporator and the electrode element, causing water condensed on the surface of the fins of evaporator to bear negative charge and the electrode element to bear positive charge and thereby allowing the water on the evaporator to be driven by the electric field to leave the evaporator at an accelerated speed.

4 Claims, 2 Drawing Sheets

WATER REMOVING MECHANISM FOR EVAPORATOR IN A REFRIGERATION SYSTEM

FIELD OF THE INVENTION

This invention relates to water removing mechanisms and more particularly, to a water removing mechanism for removing water from an evaporator equipped in a refrigeration system.

BACKGROUND OF THE INVENTION

The electrohydrodynamic (EHD) technology is one that employs a set of electrodes to generate an electric field with high voltage and low current so as to provide a fluid in the electric field with negative charge. The EHD technology is currently applied to, for example, a heat exchanger or inkjet printer. In a conventional heat exchanger a set of electrodes is disposed within a heat-exchanging fluid with low conductivity, such as CFC or equivalent refrigerant, to produce an electric field with high voltage and low current. The electric field will result in a driving force against the heat-exchanging fluid, causing the heat-exchanging fluid to be stirred to thereby increase the heat transfer efficiency of the heat-exchanging fluid.

FIG. 1 illustrates s schematic view of refrigeration cycle of a conventional refrigeration system. The refrigeration system is generally composed of a compressor 1, a condenser 2, an expansion valve 3 and an evaporator 4. In the refrigeration a low pressure, low temperature vapor refrigerant, after being compressed to a high pressure, high temperature vapor refrigerant by the compressor 1, is cooled down to a high pressure, medium temperature state in the condenser 2. Then the pressure of the high pressure, medium temperature liquid refrigerant is lowered by the expansion valve 3 to become a low pressure, medium temperature liquid refrigerator. As the liquid refrigerant from the expansion valve 3 flows through the evaporator 4 and receives heat from the ambient, the liquid refrigerator will be evaporated to become a low pressure, low temperature vapor refrigerant to complete a refrigeration cycle.

The evaporator 4 usually includes a curved continuous copper pipe that allows the refrigerant to flow inside the pipe. A number of fins are intensively arranged on the outer wall of the pipe in order to increase the heat conductive areas for the refrigerant. Also, a fan device is provided to drive air to flow through air-flowing channels formed among the fins, so that the heat exchange can occur with the air. As the temperature of the evaporator is kept low, the moisture contained in the air will be condensed on the surfaces of the fins. The water condensed from the moisture on the surfaces of the fins will then drip down to the bottom of the fins due to gravity, allowing it to be expelled from the fins.

However, the water condensed on the surfaces of the fins decreases the heat transfer areas provided by the fins so that the heat transfer efficiency of the fins is deteriorated. In order to prevent the heat transfer efficiency of the fins from deterioration, the water condensed on the surfaces of the fins has to be removed from the surfaces of the fins as fast as possible. Nevertheless, the removal of water from the surfaces of the fins of the conventional evaporator is relatively slow and time-consuming for the reason that the dripping process of water condensed on the surfaces of the fins is dependent on the gravity of the water. As a result, the removal of water from a conventional evaporator is always not efficiently performed, causing the heat transfer efficiency to be adversely affected.

SUMMARY OF THE INVENTION

The present invention was made in view of the foregoing circumstances of the prior art, and an object of the present invention is to provide a water removing mechanism for the evaporator in a refrigeration system which improves the heat transfer performance of the evaporator.

To achieve the foregoing object, according to the present invention, there is provided a water removing mechanism for the evaporator in a refrigeration system in which an electrode element is disposed beneath the evaporator and a pulse voltage source is provided to connect the evaporator and the electrode element to generate an electric field with high voltage and low current between the evaporator and the electrode element, causing water condensed on the surface of the fins of evaporator to bear negative charge and the electrode element to bear positive charge and thereby allowing the water on the evaporator to be driven by the electric field to leave the evaporator at an accelerated speed.

The electrode element can be made of a conductive material, e.g. metal, and a shape thereof as well as a distance between the electrode element and the evaporator have no specific limitations, as long as the pulse voltage source can generate on electric field sufficient to drive the water condensed on the surface of the evaporator to leave the evaporator at an accelerated speed.

BRIEF DESCRIPTION OF THE DRAWINGS

The features and advantages of the present invention may be best understood by referring to the following description of the preferred embodiment together with the accompanying drawings in which.

DETAILED DESCRIPTION OF THE PREFERRED EMBODIMENT

Figure 1:
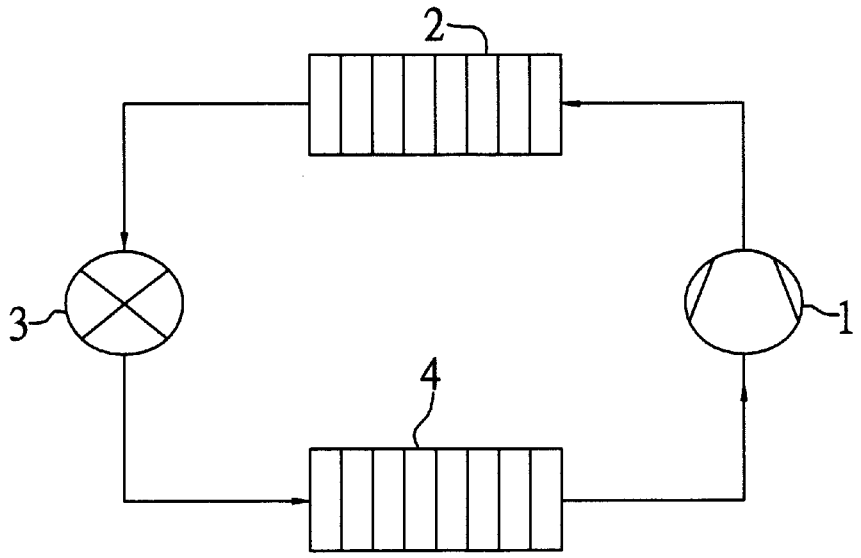
FIG. 1 is a schematic drawing illustrating a refrigeration cycle of prior art refrigeration system.
Figure 2:
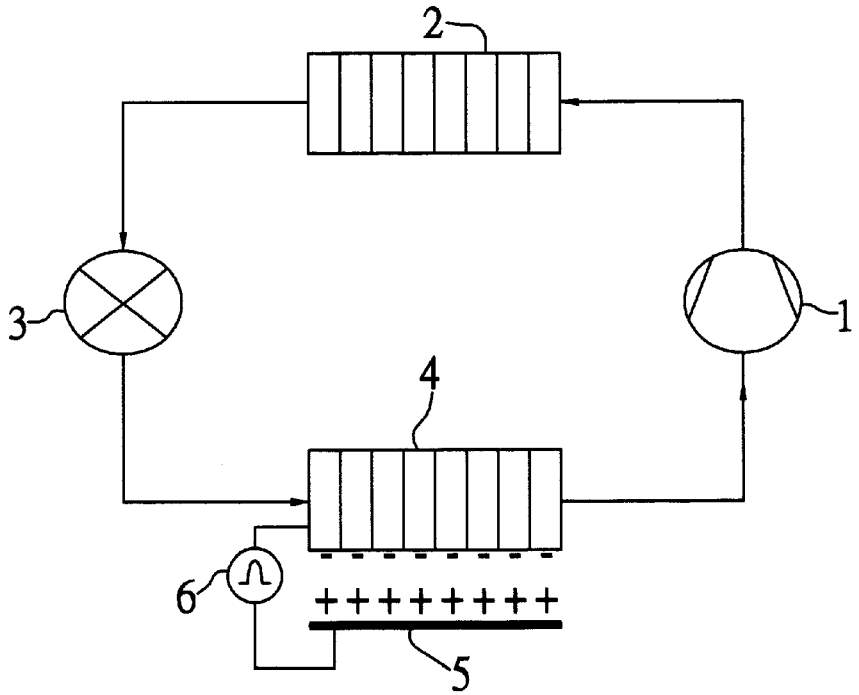
FIG. 2 is a schematic drawing illustrating a water removing mechanism disposed with an evaporator in a refrigeration system according to the present invention.

FIG. 2 illustrates a water removing mechanism disposed with an evaporator in a refrigeration system according to the present invention. The water removing mechanism of the present invention essentially comprises an electrode element 5 and a pulse voltage source 6.

As shown in the drawing, the refrigeration system is composed of a compressor 1, a condenser 2, an expansion valve 3 and an evaporator 4, as mentioned in the above. For simplification of illustration, the reference numerals of the constituent elements are to be remained the same and the description thereto will be omitted. The evaporator 4 is generally in a form of a curved continuous pipeline (not shown) with a number of spaced fins 42 (referring to FIG. 3) disposed on the surface of the pipeline in order to increase the heat exchange area for the air to be cooled down by the evaporator 4. And, a refrigerant from the expansion valve 3 is to flow through the pipeline of the evaporator 4 to perform heat exchange with the air passing through the channels formed among the fins. The electrode element 5 is comprised of a copper line and disposed beneath the evaporator 4 with a length substantially equal to the width of the evaporator 4. The pulse voltage source 6, which is electrically connected between the evaporator 4 and the electrode component 5 via an electrically conductive wire, outputs a high voltage pulse with low current to produce negative charge to water condensed on the surface of the evaporator 4 and positive charge to the electrode element 5, whereby an electric field with high voltage and low current is generated between the evaporator 4 and the electrode element 5.

It is to be noted that the pulse voltage source 6 can be any type of conventional pulse voltage generating means or electric circuit capable of generating a high voltage pulse. In the present preferred embodiment, the pulse voltage source 6 is consisted of a flyback transformer and electric circuits for producing an electric field with high voltage and low current. As the structure of the pulse voltage source 6 is known and can be easily achieved by persons skilled in the art, a description thereto and drawings thereof are hereby omitted.

Figure 3:
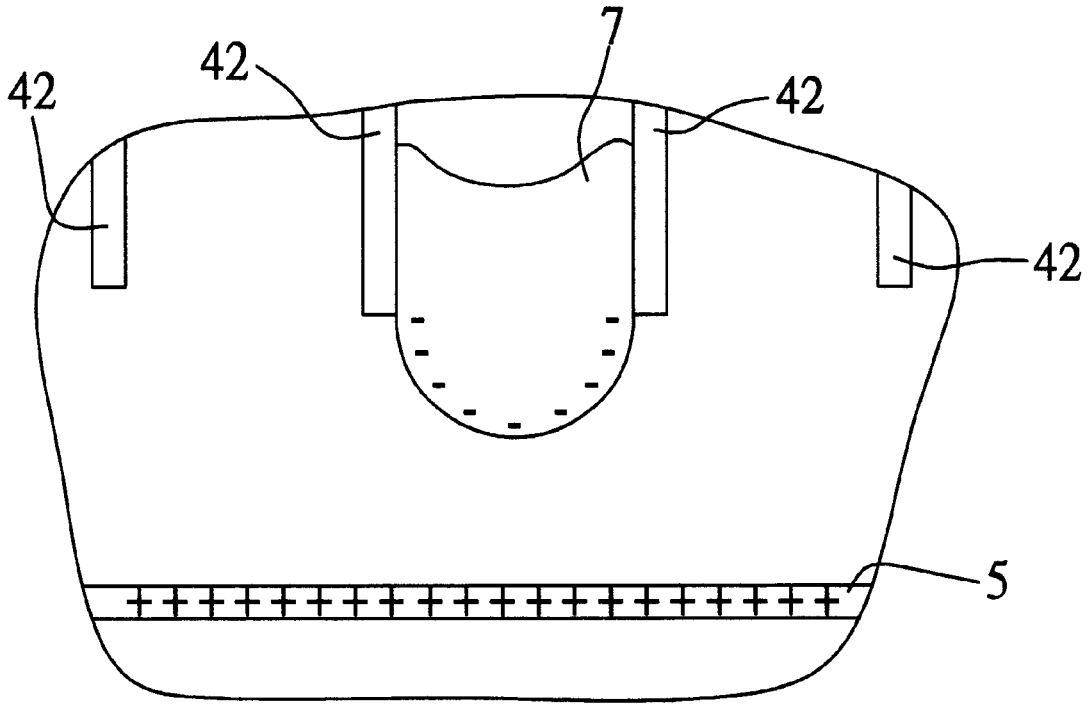
FIG. 3 is an enlarged view showing the electrode element and the water condensed on the fins of the evaporator.

FIG. 3 is an enlarged view showing the electrode element 5 and the water 7 condensed on the fins 42 of the evaporator 4. As the water 7 has a higher dielectric constant, it can be easily negatively charged by the pulse voltage source 6. Therefore the water 7 condensed on the fins 4*a* of the evaporator 4 is to bear negative charge and can will then be driven by the electric field toward the electrode element 5 with positive charge. As a result, the water 7 is accelerated to leave the evaporator 4 and then to be expelled.

The inventor has made many experiments as well as adjustments based on factors such as the material to be used, shape of the electrode element, the distance between the electrode element and the output voltage of the pulse voltage source of the present invention, and then has obtained desired results. Tests have shown that an evaporator equipped with the water removing mechanism of the present invention in an air conditioner expelles water condensed on the surface of the evaporator 15% more than a conventional evaporator without the water removing mechanism of the present invention in an air conditioner.

As a result, the present examples are to be considered as illustrative and not restrictive, and the invention is not to be limited to the details given herein, but may be modified within the scope of the appended claims.

What is claimed is:

1. A water removing mechanism for an evaporator in a refrigeration system, comprising:

an electrode element disposed beneath the evaporator; and a pulse voltage source electrically connected between the evaporator and the electrode element to produce an electric field between the evaporator and the electrode element to have the water condensed on the surface of the evaporator to be negatively charged and the electrode element to be positively charged, allowing the water on the surface of the evaporator to be accelerated to leave the evaporator.

2. The water removing mechanism as claimed in claim 1, wherein the electrode element is an electrically conductive line.

3. The water removing mechanism as claimed in claim 1, wherein the electrode element is of a length corresponding to the width of the evaporator.

4. The water removing mechanism as claimed in claim 1, wherein the pulse voltage source comprises a flyback transformer and electric circuits.

* * * * *